US006346914B1

(12) United States Patent
Annamaa

(10) Patent No.: US 6,346,914 B1
(45) Date of Patent: Feb. 12, 2002

(54) PLANAR ANTENNA STRUCTURE

(75) Inventor: Petteri Annamaa, Oulu (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 09/634,749

(22) Filed: Aug. 9, 2000

(30) Foreign Application Priority Data

Aug. 25, 1999 (FI) ..... 1991807

(51) Int. Cl.[7] ..... H01Q 1/24; H01Q 1/38

(52) U.S. Cl. ..... 343/700 MS; 343/702; 343/767

(58) Field of Search ..... 343/700 MS, 767, 343/702; H01G 1/38, 1/24

(56) References Cited

U.S. PATENT DOCUMENTS 5,926,139 A 7/1999 Korisch 6,195,048 B1 * 2/2001 Chiba et al. ..... 343/700 MS

FOREIGN PATENT DOCUMENTS

| | | | |
|---|---|---|---|
| DE | 197 15 206 A1 | 10/1998 | ..... H01Q/1/36 |
| EP | 0 590 671 A1 | 4/1994 | ..... H01Q/1/24 |
| WO | WO 98/38694 | 9/1998 | ..... H01Q/9/04 |

* cited by examiner

*Primary Examiner*—Michael C. Wimer
(74) *Attorney, Agent, or Firm*—Darby & Darby

(57) ABSTRACT

The invention relates to the structure of a dual-band planar antenna. The radiating element (210) in a planar antenna (200) has a slot consisting of two portions of different widths. One end of the wider portion (216) of the slot is close to the feed point (S) of the radiating element. The narrower portion (217) of the slot starts from a point in the wider portion and extends to the edge of the radiating element. The portions of the slot are advantageously straight. The order of magnitude of the ratio ($w_1/w_2$) of the widths of the portions is three. An advantage of the invention is that the bandwidths of a dual-band planar antenna are larger than those of prior-art structures of the same size.

7 Claims, 4 Drawing Sheets

PLANAR ANTENNA STRUCTURE

The invention relates to a dual-band planar antenna structure applicable in mobile communication devices, for example.

Mobile communication devices, especially those operating at two frequency bands, have grown more popular in recent years, subsequent to the introduction of frequency ranges around the two-gigahertz region. The lower frequency band is usually 890–960 MHz used by the GSM (Global System for Mobile telecommunications) system or 824–894 MHz used by the American AMPS (Advanced Mobile Phone System) network. The upper operating frequency band may be e.g. 1710–1880 MHz used by the DCS (Digital Cellular System) and PCN (Personal Communication Network) or 1850–1990 MHz used by the PCS (Personal Communication System). The future UMTS (Universal Mobile Telecommunication System) has been allocated transmission and reception bands in the 1900–2170 MHz range. Thus it is obvious that the operating bands may be relatively wide, which sets additional requirements on the antenna of a mobile communication device.

Figure 1:
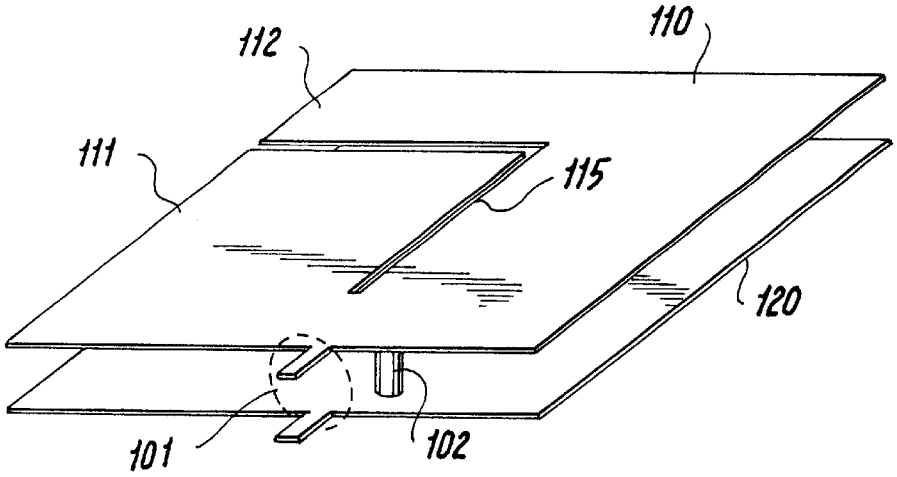
Fig. 1 (Prior Art)

From the prior art it is known a number of antenna structures that have at least two operating frequency bands. Mobile communication devices use various combination antennas such as a combination of a whip and helix antenna or a combination of a whip and planar inverted-F antenna (PIFA). In addition, PIFA-type antennas are known which by themselves operate at two frequency ranges. FIG. 1 shows one such prior-art antenna structure. It comprises a radiating plane 110, a ground plane 120 parallel to said radiating plane, and a short-circuit element 102 between these two planes. In this example, the antenna is fed at a position 101 of its edge. The radiating plane 110 has a relatively narrow slot 115 in it, starting at one edge of the plane, making a rectangular bend, and extending close to the feed position 101. Viewed from the feed position, the slot 115 divides the plane 110 up into two branches 111 and 112. Operation at two frequency bands is based on the fact that these branches have quite different resonance frequencies. Antenna matching can be adjusted by varying the feed position 101 as well as the location of the short circuit 102. Desired values for the resonance frequencies of the antenna can be obtained by varying the location of the slot 115 and the number of bends in it. The disadvantage of the structure is that it may be difficult to accomplish a sufficient bandwidth at both operating frequency ranges. The frequency bands can be widened by increasing the distance between the radiating element and ground plane, but this arrangement has the drawback of making the antenna larger.

The primary object of the invention is to improve the band characteristics of a dual-band PIFA. The structure according to the invention is characterized by what is expressed in the independent claim 1. Preferred embodiments of the invention are presented in the other claims.

Described briefly, the invention is as follows: In the radiating element of the PIFA there is provided a slot consisting of two portions having different widths. One end of the wider portion of the slot is close to the feed point of the radiating element. The narrower portion of the slot begins at a point in the wider portion and extends to the edge of the radiating element. The portions of the slot are advantageously straight, but the narrower portion may have bends in it in order to form the branches of the radiating element. The ratio of the widths of the portions of the slot is order of three.

An advantage of the invention is that the bandwidths of a dual-band PIFA can be made larger than those of prior-art structures of the same size. Another advantage of the invention is that the structure according to it is simple and has relatively low manufacturing costs.

Figure 5:
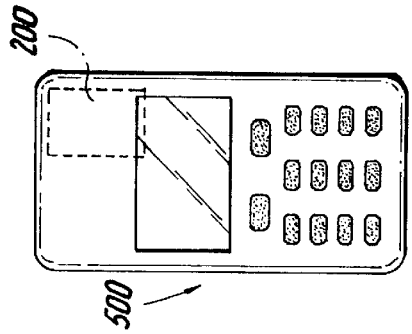
Figure 4A:
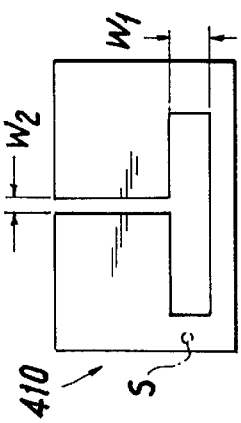
Figure 4B:
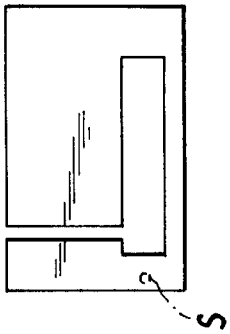
Figure 4C:
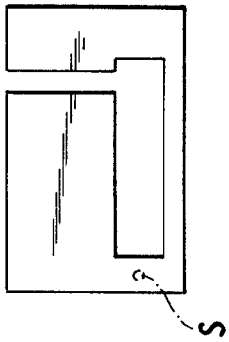
Figure 4D:
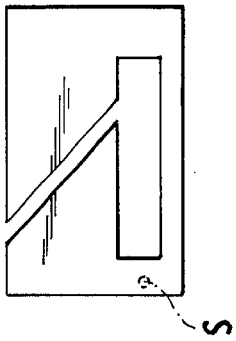
Figure 4E:
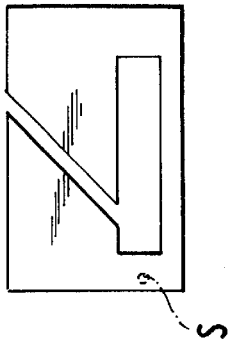
Figure 4F:
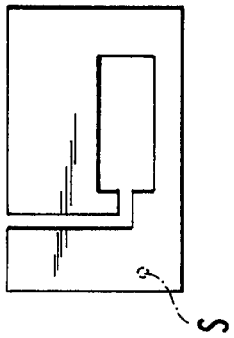
Figure 4G:
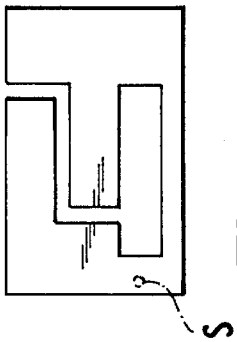
Figure 4H:
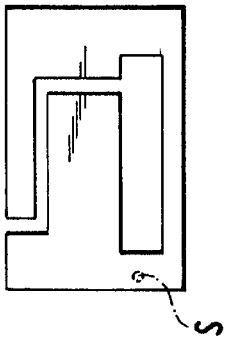
Figure 4I:
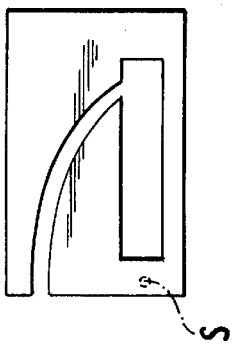

The invention will now be described in detail. Reference will be made to the accompanying drawing wherein FIG. 1 shows an example of a PIFA according to the prior art, FIG. 2 shows an example of a PIFA according to the invention, FIG. 3*a* shows an example of the effect on the antenna characteristics of the narrower portion of the slot, FIG. 3*b* shows an example of the effect on the antenna bandwidths of the ratio of the widths of the portions of the slot, FIGS. 4*a–i* show alternative radiating element shapes according to the invention, and FIG. 5 shows an example of a mobile communication device equipped with an antenna according to the invention.

FIG. 1 was already discussed in connection with the description of the prior art.

Figure 2:
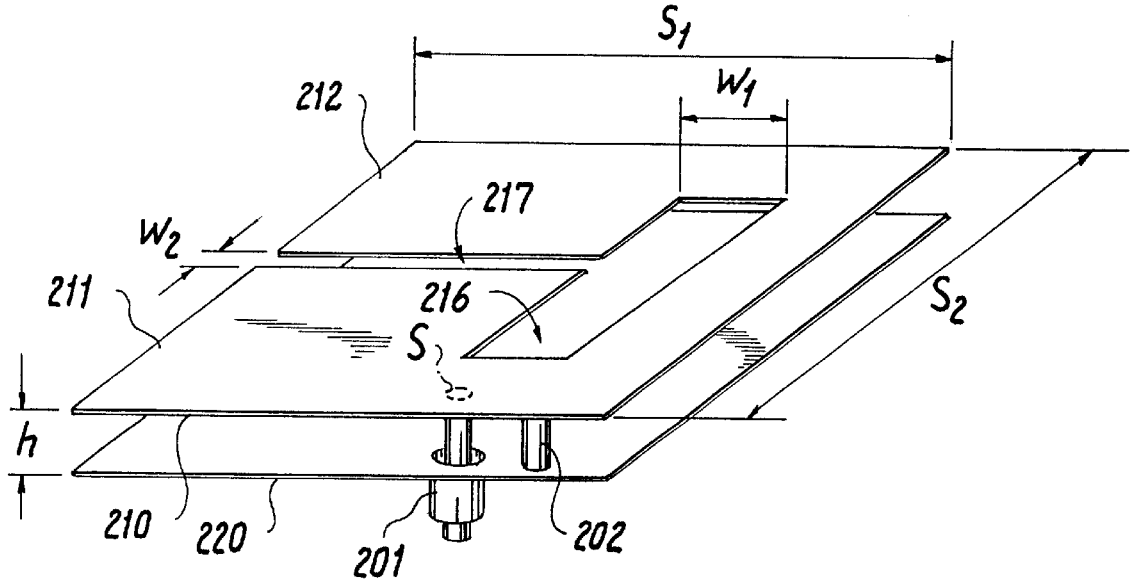
Figure 3A:
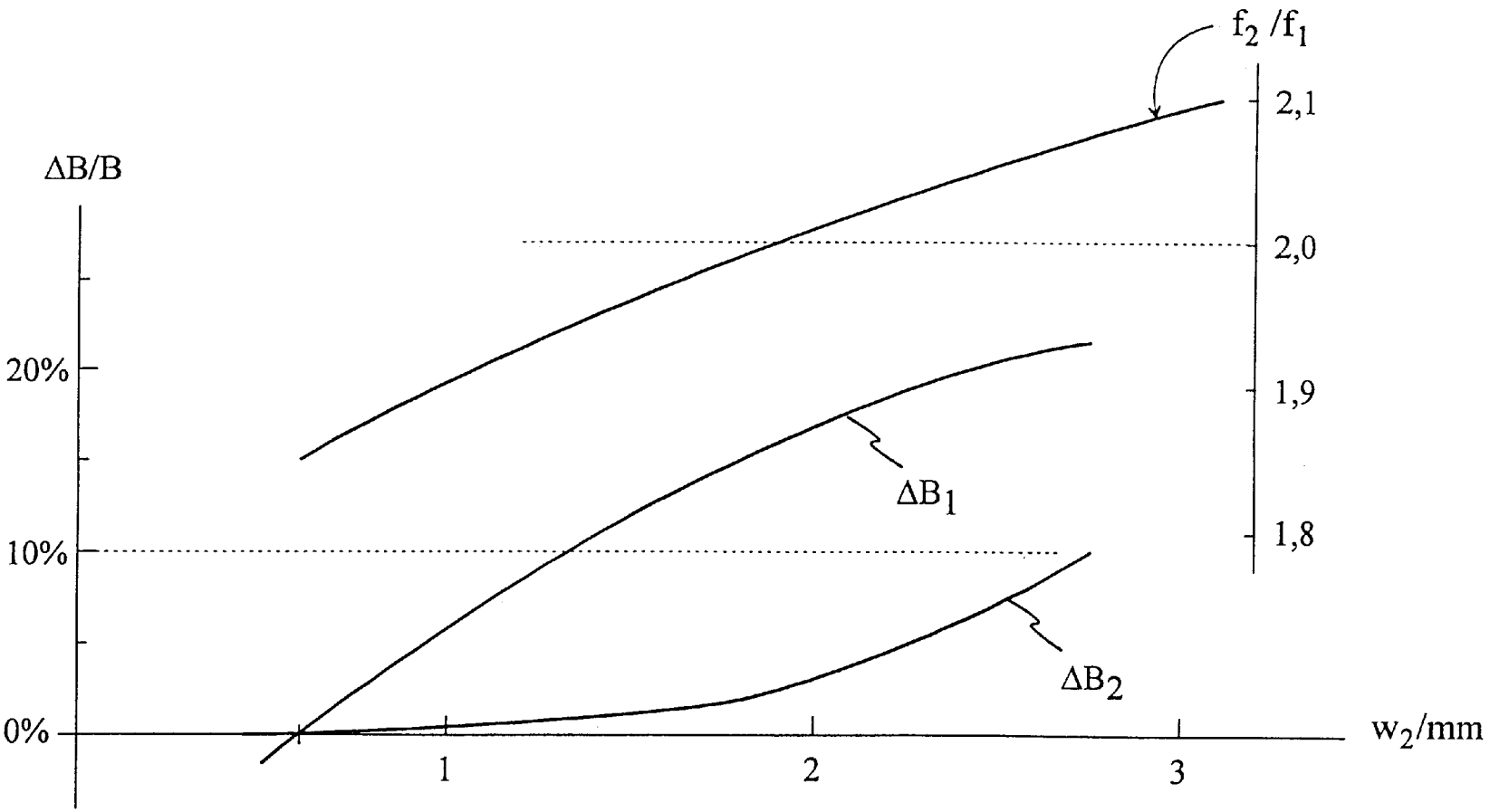
Figure 3B:
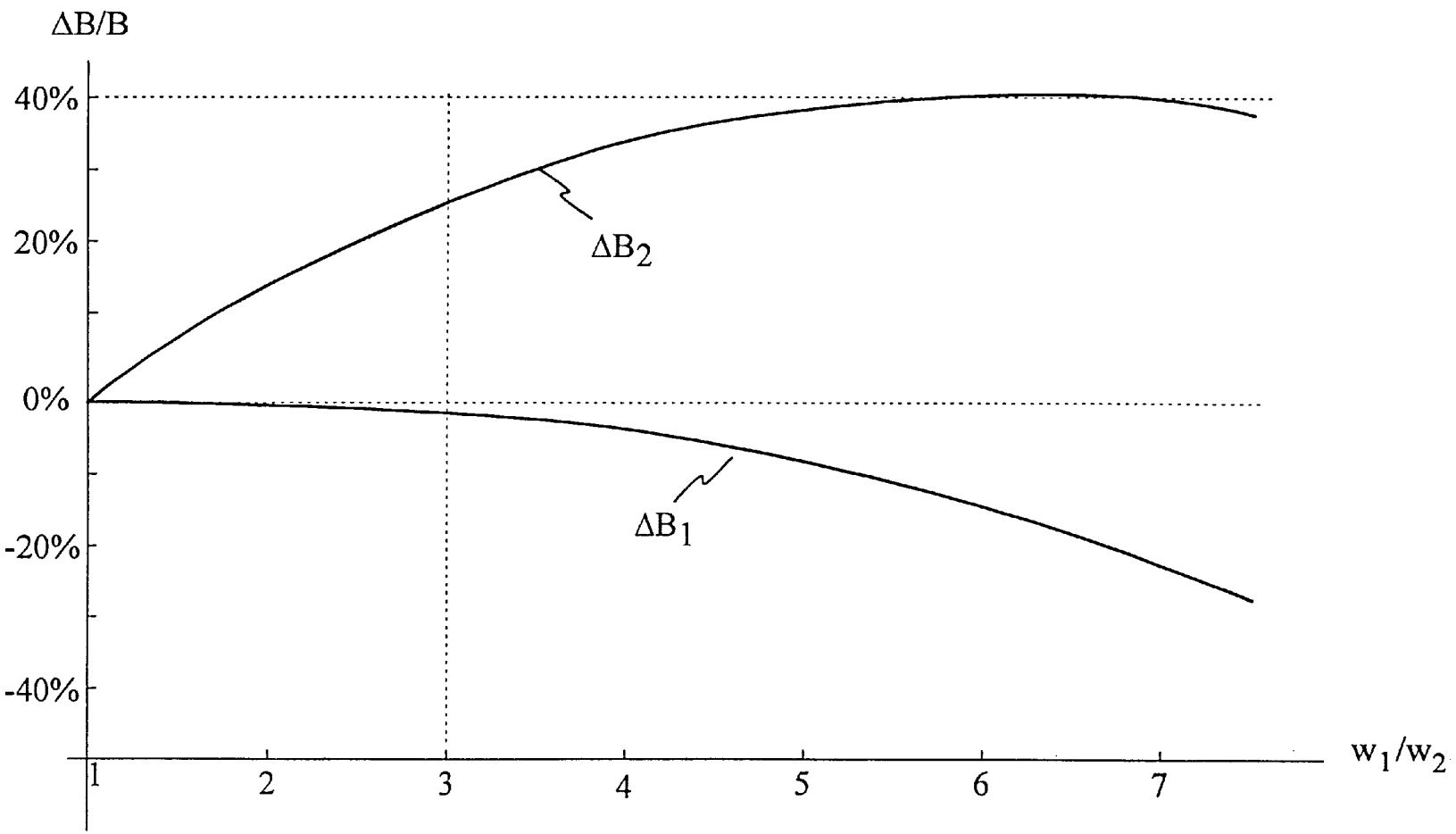

FIG. 2 shows an example of the antenna structure according to the invention, drawn simplified, without any supporting structures. The antenna 200 comprises a radiating element 210, ground plane 220 and a short-circuit element 202 between these two. The outer conductor of the antenna feed line 201 is connected to the ground plane from underneath in the drawing. The inner conductor of the feed line is connected through a hole in the ground plane to the radiating plane 210 at a point S, close to the front edge of the radiating element in this figure. What is essential regarding the invention is the shape of the slot in the radiating element. The slot consists of two portions. The first portion 216 is rectangular, having a width of $w_1$, the longer side of which is longitudinally positioned. The first portion 216 of the slot is entirely within the area of the element 210 and it extends relatively close to the element feed point S. The second portion 217 of the slot is rectangular, too, in this example. The second portion opens into the first portion 216 on its longer side and extends transversely to the left-hand longitudinal edge of the radiating element. The width of the second portion 217 is $w_2$. The first and second portions together divide the radiating element 210, viewed from the feed point S, into two branches 211 and 212 which have different resonance frequencies.

Transverse direction means in this description and in the claims the direction of the front edge of the radiating element, i.e. the edge that is closest to the feed point S. Conversely, longitudinal direction means in this description and in the claims the direction of the edges essentially perpendicular to the transverse direction of the radiating element.

In the structure according to the invention the widths $w_1$ and $w_2$ of the slot portions are relatively great, which is due to the objective of increasing the antenna bandwidths. Making the slots wider decreases the coupling between the branches 211 and 212, which makes the bandwidths larger. Furthermore, another radiation mechanism begins to operate to a significant extent in the antenna: branches 211 and 212 and the capacitance between them in slot 217, when they are suitably dimensioned, act as a loop antenna at the upper operating frequency band, which can be utilized in making the upper operating band wider.

An advantageous size of the structure in FIG. 2 is e.g. as follows: The traverse length $s_1$ of radiating element 210 is 20 mm, the longitudinal length $s_2$ of of radiating element is 35 mm and the height h of antenna structure is 5–6 mm.

FIG. 3*a* shows an example of the effect of the width $w_2$ of the second, i.e. narrower, portion of the slot in the radiating element on the band characteristics of the antenna. Shown in the Figure are the relative changes of the lower operating band $\Delta B_1$ and upper operating band $\Delta B_2$ as well as the ratio $f_2/f_1$ of the center frequencies of the upper and lower operating bands as a function of the width of the second portion of the slot. As the slot width $w_2$ grows from 0.6 mm to 2.8 mm, the width $\Delta B_1$ of the lower operating band grows by a little more than 20%, relatively quickly at first and more slowly at the end. The width $\Delta B_2$ of the upper operating band grows by about 10%, slowly at first and more quickly at the end. As the slot width $w_2$ grows from 0.6 mm to 2.8 mm, the ratio $f_2/f_1$ of the center frequencies of the upper and lower operating bands grows from about 1.85 to about 2.1. These results are valid for antenna dimensions where the width $w_1$ of the first portion of the slot is 4.5 mm.

FIG. 3*b* illustrates the effect of the ratio of the widths of the portions of the slot in the radiating element on the bandwidths of the antenna. The Figure shows that as the ratio $w_1/w_2$ of the slot widths grows from 1 to 7, the width $\Delta B_1$ of the lower operating band decreases by nearly 25%, slowly at first and more quickly at the end. Similarly, as the ratio $w_1/w_2$ of the slot widths grows from 1 to 6, the width $\Delta B_2$ of the upper operating band grows by about 40%, relatively quickly at first and more slowly at the end. As the ratio $w_1/w_2$ grows further, the bandwidth $\Delta B_2$ starts to decrease slowly.

The prior art corresponds to a structure in which the widths of the portions of the slot in the radiating element are both relatively small, well under 1 mm. FIGS. 3*a* and 3*b* show e.g. that the structure according to the invention makes possible a bandwidth 20% larger, at least for the upper operating band. Let us assume e.g. that the center frequencies desired are $f_1$=925 MHz and $f_2$=1795 MHz. The ratio $f_2/f_1$ is then 1.94. This corresponds according to FIG. 3*a* to a width $w_2$ of about 1.3 mm. If width $w_1$ is 4.5 mm, as in FIG. 3*b,* the ratio $w_1/w_2$ is 3.4, approximately. Compared to an imaginary situation in which both widths $w_1$ and $w_2$ are 0.6 mm, the increase in the width $B_1$ of the lower operating band is about 10−2=8%, and the increase in the width $B_2$ of the upper operating band is about 29+1=30%.

In practice, the dimensions of the antenna are not obtained direct from the curves according to FIGS. 3*a* and 3*b*. First, it is selected a relatively high value for the width $w_1$. Then it is found a value for the width $w_2$ such that the frequency ratio $f_2/f_1$ is correct. This procedure is iterated until both the values of the frequencies $f_1$ and $f_2$ and their ratio are correct. The aim is that the ratio $w_1/w_2$ of the slot widths is between 2 and 4. This ensures a relatively large increase in the width $B_2$ of the upper operating band without a considerable decrease in width $B_1$ of the lower operating band from the value that it has on the basis of the enlarged width $w_2$.

FIG. 4 shows a few alternative radiating element shapes. The top leftmost subfigure (a) shows a shape that corresponds to FIG. 2. In that shape the wider, i.e. the first, portion of the slot is longitudinal in relation to the radiating element 410 and is relatively close to that longitudinal edge of the element 410 which is shown lower in the figure. The narrower, i.e. the second, portion of the slot starts at the middle of the first portion, approximately, and extends transversely and directly to that longitudinal edge of the element 410 which is shown upper in the figure. Subfigure (b) shows a shape in which the second portion of the slot starts from a location close to that end of the first portion which is closest to the element feed point S. Subfigure (c) shows a shape in which the second portion of the slot starts from a location close to that end of the first portion which is farthest away from the feed point S of the element. Subfigure (d) shows a shape in which the second portion of the slot starts from a location close to that end of the first portion which is farthest away from the feed point S of the element and continues obliquely, opening into the longitudinal edge of the element near the edge closest to the feed point. Subfigure (e) shows a shape in which the second portion of the slot starts from a point close to that end of the first portion which is closest to the feed point S of the element and continues obliquely, opening into the longitudinal edge of the element closer to the edge opposite to the feed point. Subfigure (f) shows a shape in which the second portion of the slot starts longitudinally from that end of the first portion which is closest to the feed point S of the element, makes a rectangular turn and extends transversely to the upper longitudinal edge of the element. Subfigure (g) shows a shape in which the second portion of the slot starts transversely from a location close to that end of the first portion which is closest to the feed point S of the element, continues longitudinally towards the opposite end of the element and fully extends transversely to the upper longitudinal edge of the element. Subfigure (h) shows a shape in which the second portion of the slot starts transversely from a location close to that end of the first portion which is opposite to the element feed point S, continues longitudinally towards the end closest to the element feed point and finally extends transversely to the upper longitudinal edge of the element. Subfigure (i) shows a shape in which the second portion of the slot starts from a location close to that end of the first portion which is farthest away from the feed point S of the element and curves to that edge of the element which is closest to the feed point.

FIG. 5 shows a mobile communication device 500. It comprises an antenna 200 according to the invention, located entirely inside the housing of the mobile communication device.

Above it was described the basic solution according to the invention and some variants thereof As regards the design of the radiating element, the invention is not limited to the solutions described. Moreover, the invention does not limit other structural solutions of the planar antenna, nor its manufacturing method. The inventional idea can be applied in different ways without departing from the scope defined by the independent claim 1.

What is claimed is:

1. An antenna structure comprising a radiating plane and ground plane, said radiating plane having a slot extending to its edge in order to create two separate operating frequency bands, characterized in that said slot comprises a first portion (216), which is substantially longitudinal, and a second portion (217), which at one end opens into said first portion and at the other end to the edge of the radiating element, the ratio of the width of the first portion to the width of the second portion being greater than one and a half.

2. The structure of claim 1 in which said first portion is substantially shaped like a rectangle the shorter side of which is the aforementioned width of the first portion, characterized in that the intersection of the first portion and second portion is on the longer side of the first portion.

3. The structure of claim 1 in which said first portion is substantially shaped like a rectangle the shorter side of which is the aforementioned width of the first portion, characterized in that the intersection of the first portion and second portion is on the shorter side of the first portion.

4. The structure of claim 1, characterized in that said second portion is substantially straight.

5. The structure of claim 1, characterized in that said second portion has at least one substantially rectangular bend.

6. The structure of claim 1, characterized in that the ratio of the width of said first portion to the width of said second portion is greater than two and less than four.

7. A radio apparatus (500), characterized in that its antenna (200) comprises a radiating plane and ground plane, which radiating plane has a slot so as to create two separate operating frequency ranges, which slot comprises a first portion substantially longitudinal, and a second portion, which at one end opens into said first portion and at the other end to the edge of the radiating element, the ratio of the width of the first portion to the width of the second portion being greater than one and a half.

* * * * *

UNITED STATES PATENT AND TRADEMARK OFFICE

CERTIFICATE OF CORRECTION

PATENT NO. : 6,346,914 B1
DATED : February 12, 2002
INVENTOR(S) : Petteri Annamaa It is certified that error appears in the above-identified patent and that said Letters Patent is hereby corrected as shown below:

Title page,
Item [30], Foreign Application Priority Data, delete "……..1991807" and substitute -- ……..19991807 --.

Signed and Sealed this

Fifteenth Day of October, 2002

*Attest:*

*Attesting Officer*

JAMES E. ROGAN
*Director of the United States Patent and Trademark Office*